US009725977B2

(12) United States Patent
Laird et al.

(10) Patent No.: US 9,725,977 B2
(45) **Date of Patent: *Aug. 8, 2017**

(54) RETRACTABLE CUTTING AND PULLING TOOL WITH UPHOLE MILLING CAPABILITY

(71) Applicant: BAKER HUGHES INCORPORATED, Houston, TX (US)

(72) Inventors: Mary L. Laird, Madisonville, LA (US); Robbie B. Colbert, Perdido, AL (US)

(73) Assignee: Baker Hughes Incorporated, Houston, TX (US)

( * ) Notice: Subject to any disclaimer, the term of this patent is extended or adjusted under 35 U.S.C. 154(b) by 245 days.

This patent is subject to a terminal disclaimer.

(21) Appl. No.: 14/504,995

(22) Filed: Oct. 2, 2014

(65) Prior Publication Data

US 2015/0129195 A1 May 14, 2015

Related U.S. Application Data

(63) Continuation-in-part of application No. 13/645,118, filed on Oct. 4, 2012, now Pat. No. 9,366,101.

(51) Int. Cl.
*E21B 31/16* (2006.01)
*E21B 29/00* (2006.01)

(52) U.S. Cl.
CPC ..... *E21B 29/005* (2013.01); *E21B 29/002* (2013.01); *E21B 31/16* (2013.01)

(58) Field of Classification Search
CPC ..... E21B 10/32; E21B 10/322; E21B 29/00; E21B 29/002; E21B 29/005; E21B 31/16; E21B 31/20
See application file for complete search history.

(56) References Cited

U.S. PATENT DOCUMENTS 1,485,642 A 3/1924 Stone
1,789,995 A * 1/1931 Barkis ..... E21B 29/005 166/55.8

(Continued)

FOREIGN PATENT DOCUMENTS

WO 2011031164 A1 3/2011

OTHER PUBLICATIONS

Guimaraes, Zacarais, et al., "Engineering Development to Improve Tubular Cutting Ability in High-Ductility Metallurgy Strings with Low-Torque Motors", SPE 121671, Mar. 2009, 1-13.

(Continued)

*Primary Examiner* — Robert E Fuller
*Assistant Examiner* — David Carroll
(74) *Attorney, Agent, or Firm* — Steve Rosenblatt

(57) ABSTRACT

Cutter blades extend and stay extended as long as pressure on a piston is continued. The blades either open fully in open hole or cut through the wall of a tubular and then mill in an uphole direction to take out a piece of the tubular. The piston that held out the blades when pressure was applied is acted on by a return bias when the pressure is removed so that the blades can retract and the tool removed through the cut tubular. As a backup a plug can be dropped to obstruct a through passage in the piston so that pressure from the surface can be used to force the piston back to retract the blades. Continued drilling operations or the cut and milled portion can be then blocked off such as with cement for a plug and abandonment of the well.

19 Claims, 3 Drawing Sheets

(56) References Cited

U.S. PATENT DOCUMENTS

| | | | | |
|---|---|---|---|---|
| 2,136,518 | A | 11/1938 | Nixon | |
| 2,167,739 | A | 8/1939 | Beck | |
| 2,353,284 | A | 7/1944 | Barrett | |
| 2,481,637 | A * | 9/1949 | Yancey | B23D 21/00 166/55.1 |
| 2,482,674 | A | 9/1949 | Kriegel | |
| 2,735,485 | A | 2/1956 | Metcalf, Jr. | |
| 2,888,806 | A | 6/1959 | Teumer | |
| 3,516,491 | A | 6/1970 | Lewis | |
| 4,132,270 | A | 1/1979 | Holland | |
| 4,191,255 | A | 3/1980 | Rives | |
| 4,582,134 | A | 4/1986 | Gano et al. | |
| 4,646,826 | A | 3/1987 | Bailey et al. | |
| 4,776,394 | A | 10/1988 | Lynde et al. | |
| 4,809,793 | A | 3/1989 | Hailey | |
| 4,856,642 | A | 8/1989 | Nicholson et al. | |
| 4,887,668 | A | 12/1989 | Lynde et al. | |
| 4,995,466 | A | 2/1991 | Snow, Jr. | |
| 5,014,780 | A | 5/1991 | Skipper | |
| 5,018,580 | A | 5/1991 | Skipper | |
| 5,036,921 | A | 8/1991 | Pittard et al. | |
| 5,123,489 | A | 6/1992 | Davis et al. | |
| 5,150,755 | A | 9/1992 | Cassel et al. | |
| 5,242,017 | A | 9/1993 | Hailey | |
| 5,265,675 | A | 11/1993 | Hearn et al. | |
| 5,297,630 | A | 3/1994 | Lynde et al. | |
| 5,297,638 | A | 3/1994 | Dolence, Jr. | |
| 5,373,900 | A | 12/1994 | Lynde et al. | |
| 5,385,205 | A | 1/1995 | Hailey | |
| 5,456,312 | A | 10/1995 | Lynde et al. | |
| 5,458,208 | A | 10/1995 | Clarke | |
| 5,720,343 | A | 2/1998 | Kilgore et al. | |
| 5,788,000 | A | 8/1998 | Maury et al. | |
| 5,791,409 | A | 8/1998 | Flanders | |
| 5,829,518 | A | 11/1998 | Gano et al. | |
| 5,833,018 | A | 11/1998 | Von Gynz-Rekowski | |
| 5,899,268 | A | 5/1999 | Lynde et al. | |
| 6,125,929 | A | 10/2000 | Davis et al. | |
| 6,276,452 | B1 | 8/2001 | Davis et al. | |
| 6,536,532 | B2 | 3/2003 | Doane | |
| 6,702,031 | B2 | 3/2004 | Doane et al. | |
| 6,739,415 | B2 | 5/2004 | Mitchell et al. | |
| 7,036,611 | B2 | 5/2006 | Radford et al. | |
| 7,063,155 | B2 | 6/2006 | Ruttley | |
| 7,134,504 | B2 | 11/2006 | Doane et al. | |
| 7,308,937 | B2 | 12/2007 | Radford et al. | |
| 7,325,612 | B2 | 2/2008 | Hendrickson et al. | |
| 7,412,761 | B2 | 8/2008 | Male et al. | |
| 7,467,661 | B2 | 12/2008 | Gordon et al. | |
| 7,661,470 | B2 | 2/2010 | Doane et al. | |
| 7,766,086 | B2 | 8/2010 | Mondelli et al. | |
| 7,823,632 | B2 | 11/2010 | McAfee et al. | |
| 2001/0020530 | A1 | 9/2001 | Eaton | |
| 2001/0032722 | A1 | 10/2001 | Eaton | |
| 2002/0038727 | A1 | 4/2002 | Moore et al. | |
| 2002/0117337 | A1 | 8/2002 | Moore et al. | |
| 2002/0162659 | A1 | 11/2002 | Davis et al. | |
| 2004/0188147 | A1 | 9/2004 | Mitchell et al. | |
| 2004/0251027 | A1 | 12/2004 | Sonnier et al. | |
| 2005/0034876 | A1 | 2/2005 | Doane et al. | |
| 2005/0116469 | A1 | 6/2005 | Parker | |
| 2005/0133224 | A1 | 6/2005 | Ruttley | |
| 2005/0178558 | A1 | 8/2005 | Kolle et al. | |
| 2005/0224226 | A1 | 10/2005 | Read, Jr. et al. | |
| 2006/0048950 | A1 | 3/2006 | Dybevik et al. | |
| 2006/0075889 | A1 | 4/2006 | Walker | |
| 2006/0137877 | A1 | 6/2006 | Watson et al. | |
| 2006/0196036 | A1 | 9/2006 | Male et al. | |
| 2006/0243445 | A1 | 11/2006 | Hendrickson et al. | |
| 2009/0050310 | A1 | 2/2009 | McKay | |
| 2009/0321063 | A1 | 12/2009 | Bryant, Jr. et al. | |
| 2010/0038080 | A1 | 2/2010 | McAfee et al. | |
| 2010/0051292 | A1 | 3/2010 | Trinh et al. | |
| 2010/0089583 | A1* | 4/2010 | Xu | E21B 10/322 166/298 |
| 2010/0288491 | A1 | 11/2010 | Cochran et al. | |
| 2011/0220357 | A1* | 9/2011 | Segura | E21B 29/005 166/298 |
| 2013/0168076 | A1 | 7/2013 | Davis | |

OTHER PUBLICATIONS

Portman, L.N., et al., "28% Chrome, 32% Nickel: A Case History on the Downhole Cutting of Exotic Completions", SPE 99917, Apr. 2006, 1-5.

Fitzgerald, A., et al., "New High-Performance Completion Packer Selection and Deployment for Holstein and Mad Dog Deepwater Gulf of Mexico Projects", SPE 95728, Oct. 2005, 1-20.

* cited by examiner

RETRACTABLE CUTTING AND PULLING TOOL WITH UPHOLE MILLING CAPABILITY

CROSS REFERENCE TO RELATED APPLICATION

This application is a continuation-in-part of U.S. patent application Ser. No. 13/645,118, for "Cutting and Pulling Tool with Double Acting Hydraulic Piston", published as U.S. 2014-0096947-A1, filed on Oct. 4, 2012, and claims the benefit of priority from the aforementioned application.

FIELD OF THE INVENTION

The field of the invention is cutting a pulling tools and more particularly tools that extend a cutter blade by rotation about a fixed pivot location to a flush support for the blade in an extended position so that the string above the cut can milled in an uphole direction to allow continuous drilling operation without restriction.

BACKGROUND OF THE INVENTION

Cutting tools in the past were run with spears so that the cut tubular string could be retained by the spear and then pulled out of the hole. The cutter designs were variable and many included blades that extend by sliding down a ramp and turning about a pivot that was driven by a piston that was fluid driven and a spring to retract the blades. Some examples of such designs are U.S. Pat. Nos. 5,791,409; 2,136,518; 2,167,739 and US2013/0168076. As to the latter reference, there is no pivoting action as the blades translate radially. With this orientation, the blades have to either extend out below a tubular to be milled or into a recess where another tool has already removed a tubular wall. The illustrated tool is not designed to cut through a wall of a tubular due to its blade orientation. Other styles for cutting tubular strings are illustrated in U.S. Pat. Nos. 7,823,632; 5,018,580; 4,856,642 and 5,014,780.

In the original version of the present invention several issues in the prior design are addressed and a design is presented that is a more reliable and economical. The actuating piston is flow actuated to shift and extend the cutting blades and to retain the extended blade position even after the flow is cut off. The blades are retracted with pressure on a landed plug on the piston so that a return spring is not required. The reverse movement of the piston shears out the body lock ring that had previously held the piston on the blade extended position. When the blades get through the wall of the tubular string being cut the adjacent housing squarely supports the blades that are extended radially so as to better support the cut string with reduced stress on the blades as the cut string is raised up to the point where it can be supported from slips on the rig floor so that the blades can be retracted after slacking off weight and pressuring up against a bumped plug on top of the piston.

As currently envisioned, the cutter blades extend and stay extended as long as pressure on a piston is continued. Instead of cutting off a transition in a tubular that had been expanded and removing the transition to the surface, the blades cut through the wall of a tubular and then mill in an uphole direction to take out a piece of the tubular. The piston that held out the blades when pressure was applied is acted on by a return bias when the pressure is removed so that the blades can retract and the tool removed through the cut tubular. As a backup a plug can be dropped to obstruct a through passage in the piston so that pressure from the surface can be used to force the piston back to retract the blades. In one possible use of the tool, the cut and milled portion can be then blocked off such as with cement for a plug and abandonment of the well.

These and other features will be more readily apparent to those skilled in the art from a review of the description of the preferred embodiment and the associated drawings while recognizing that the full scope of the invention is to be found in the appended claims.

SUMMARY OF THE INVENTION

Cutter blades extend and stay extended as long as pressure on a piston is continued. Instead of cutting off a transition in a tubular that had been expanded and removing the transition to the surface, the blades cut through the wall of a tubular and then mill in an uphole direction to take out a piece of the tubular. The piston that held out the blades when pressure was applied is acted on by a return bias when the pressure is removed so that the blades can retract and the tool removed through the cut tubular. As a backup a plug can be dropped to obstruct a through passage in the piston so that pressure from the surface can be used to force the piston back to retract the blades. In one possible use of the tool, the cut and milled portion can be then blocked off such as with cement for a plug and abandonment of the well.

DETAILED DESCRIPTION OF THE PREFERRED EMBODIMENT

Figure 1:
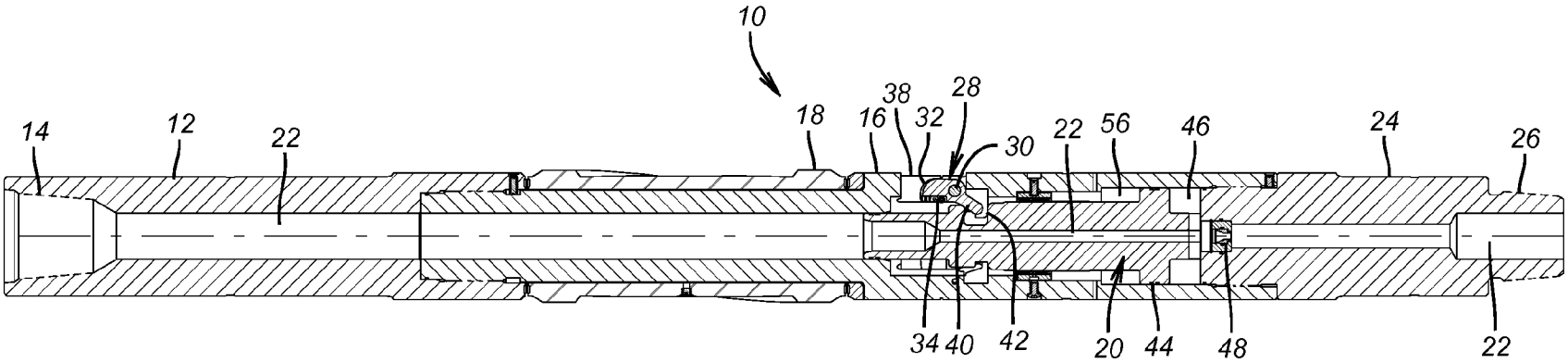
FIG. 1 is a section view of the original version of the cutting and pulling tool shown in the run in position.

The cutting and pulling tool 10 has a top sub 12 with thread 14 to which is attached a work string that is not shown that extends to a well surface also not shown. Below the top sub 12 is a body 16 that has a centralizer assembly 18 on the outside and a piston assembly 20 internally in passage 22 that starts at thread 14 and continues into the bottom sub 24. Additional tools can be attached at thread 26 as needed.

A plurality of pivoting blade assemblies 28 are preferably arranged at 120 degree spacing for a total of three although other spacing and blade counts can be used. Each blade assembly has a fixed pivot axis about a pin 30. Each blade has an arcuate cutting edge 32 with opposed parallel surfaces 34 and 36 flanking the cutting edge 32 as better seen in FIG. 4. For running in as shown in FIG. 1 the blades 28 are disposed in adjacent windows 38 in the body 16 with only a single blade assembly 28 visible in FIG. 1. Each blade assembly 28 has an actuation tab 40 extending in a generally opposite direction than the cutting edge 32 and extending from an opposite side of the pivot pin 30. The tab 40 extends into groove 42 on piston assembly 20. Piston assembly 20 has a portion of through passage 22 and a peripheral seal 44 which defines a variable volume chamber 46. A restriction or orifice 48 is disposed in the bottom sub 24 such that when fluid is pumped at a predetermined rate through passage 22 a backpressure is created behind the orifice 48 that affects the chamber 46 and drives the piston assembly 20 in an uphole direction toward the left end of FIG. 1. Such movement takes with it the recess 42 which has the effect of rotating the blade assemblies 28 clockwise about pins 30 so that the cutting edge 32 can extend outwardly to approximately a 90 degree orientation to the passage 22 as illustrated in FIG. 2.

It should be noted that in the preferred application the blade assemblies 28 are actuated outwardly in a larger tubular portion 50 that has been expanded relative to the unexpanded portion 52 that is above with a transition 54 in between which is where the cut is to take place. As shown in FIG. 2 the blade assemblies 28 are preferably extended below the transition 54 as a result of backpressure caused by orifice 48 that drives the piston assembly 20 as the chamber 46 increases in volume while the chamber 56 decreases in volume as well fluids are displaced from body 16 through passage 58 that leads out from chamber 56. A ratchet ring 60 is held in place by one or more shear pins 62 and movement of the piston assembly 20 allows a mating ratchet surface 64 on piston assembly 20 to engage the ratchet or lock ring 60 so that the movement of the piston assembly from the FIG. 1 to the FIG. 2 position cannot be reversed as long as the shear pin or pins 62 remain intact.

Figure 2:
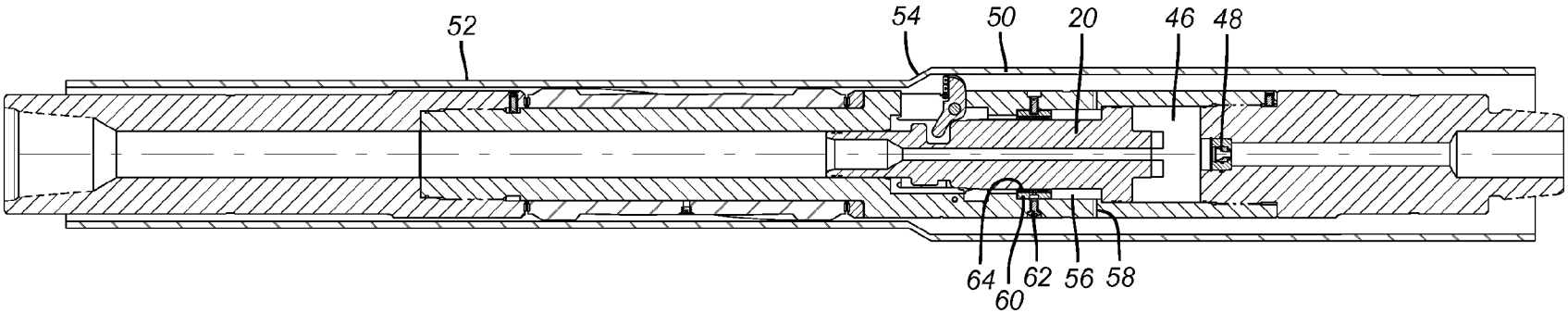
FIG. 2 is the view of FIG. 1 with the tool now in the blades extended position.
Figure 3:
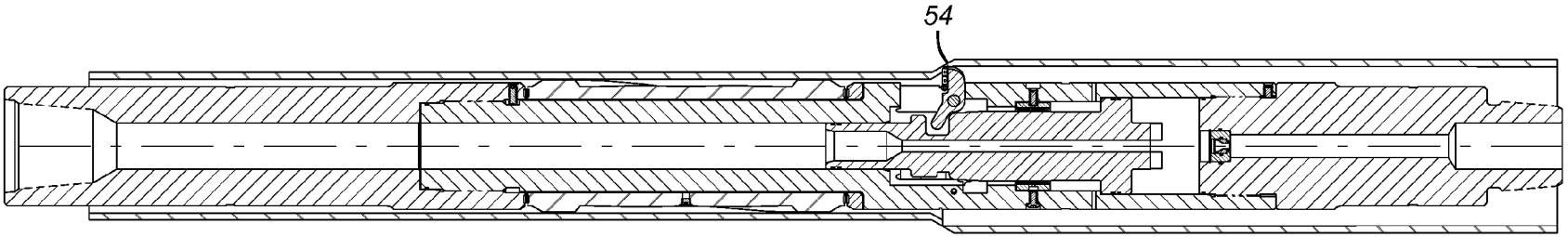
FIG. 3 is the view of FIG. 2 with the tool now in the cutting position.
Figure 4:
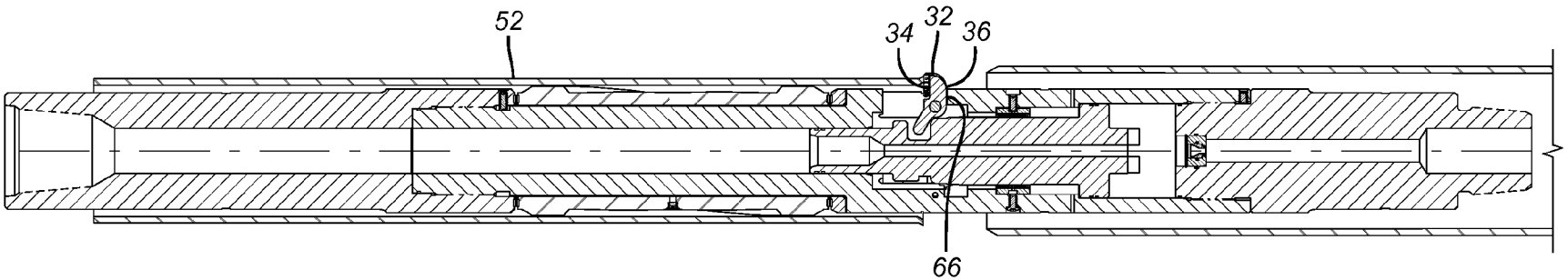
FIG. 4 is the view of FIG. 3 with the tool now in the severed string supporting position.
Figure 5:
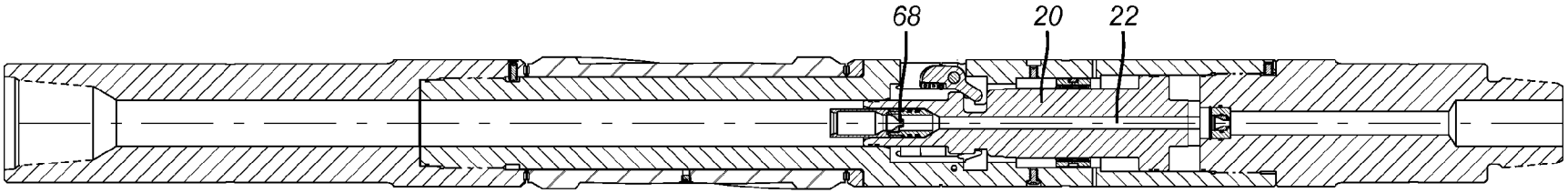
FIG. 5 is the view of FIG. 4 with the tool now in the blades retracted position and the severed string independently supported at a surface location.
Figure 6:
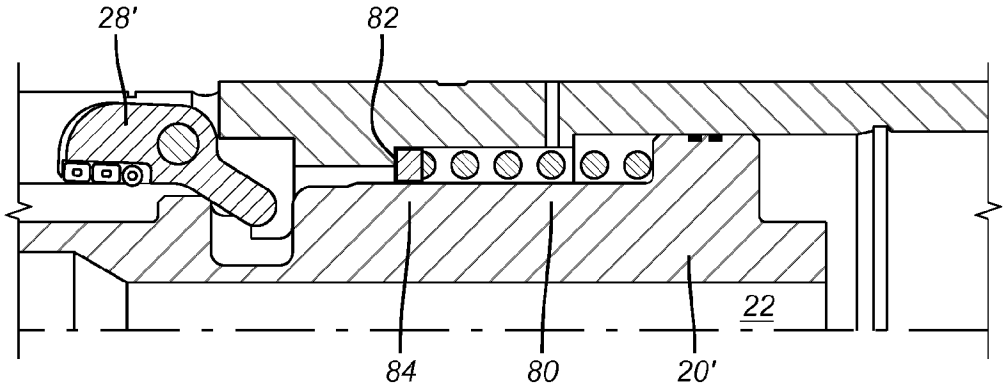
FIG. 6 is a detail of a return spring biased piston instead of using a piston locking ring as in FIG. 1.

Once the FIG. 2 position is obtained, the flow through passage 22 is cut off and the blade assemblies 28 remain extended as shown. The tool is picked up to get the blades against the transition 54 as shown in FIG. 3. An overpull force can be applied to make sure at the surface that the blade assemblies are at the right location. Thereafter the overpull force is reduced to a minimal level and the circulation and rotation from the surface or with a downhole motor can take place to make the cut as shown in FIG. 4. As a result the severed segment 52 lands on surface 34 with parallel surface 36 landing on the bottom of the window 66 as shown in FIG. 4. At this point the severed segment 52 can be lifted to the point where its top end is at the rig floor where slips can be inserted in the rotary table to support the segment 52. Once that happens, the tool 10 can be slacked off and a plug 68 can be landed in the top of the piston assembly 20 to block the passage 22 so that pressure then applied above the plug 68 breaks the shear pin 62 thus defeating the locking between surfaces 62 and 64 and pushing the piston assembly 20 in a downward direction which then rotates the blade assemblies 28 to a retracted position as shown in FIG. 5. The tool 10 can then pulled from the well.

Those skilled in the art will appreciate the various advantages of the above invention. The piston is actuated with fluid flow to extend the blades but the flow need not be maintained to keep the blades extended as a lock ring selectively holds the blades extended to make the cut. There is no return spring. Reverse piston movement occurs preferably with a dropped plug into the passage in the piston followed by pressuring up to break the shear pin or pins on the lock ring or rings so that the blade assemblies are retracted with piston movement in the downhole direction. By the time the blade assemblies finish the cut the blades are extended approximately 90 degrees to the axis of the tool so that the severed tubular string lands squarely on a radially oriented surface while the window associated with each blade assembly has a radial bottom surface on which a flat surface on the blade assembly bottoms lands so that the loading on the blade assemblies is in the axial direction with little if any radial loading component.

A variation of the above described tool is contemplated. The items 60, 62 and 64 are removed and replaced with a spring 80 acting on the piston 20' that is braced off of housing 16 using a shoulder 82 and a spring stop washer 84. The impact of this change is that the piston does not lock in the FIG. 2 position and is returned to the FIG. 1 position when pressure in passage 22 is removed. Thus cutting through a tubular and sectioning out a piece of that tubular allows a full gauge assembly to be run. The bias of the spring 80 causes blade retraction when pressure from the surface is removed in passage 22. At that point the tool 10 is removable so that continued drilling operations can take place. The option of dropping a plug 68 on the piston 20' still remains as a backup way to get the blades retracted if the spring 80 fails to do the job. While spring 80 is shown as a coiled spring other mechanical or fluid springs are contemplated to store a return force for the piston 20' when pressure is removed from passage 22. Compressed gas or a stack of Bellville washers could be substituted.

The above description is illustrative of the preferred embodiment and many modifications may be made by those skilled in the art without departing from the invention whose scope is to be determined from the literal and equivalent scope of the claims below:

We claim:

1. A cut and tubular sectioning apparatus for a subterranean tubular comprising:

a mandrel having an open mandrel passage extending between an upper and a lower end for flow therethrough;

a piston movably mounted to said mandrel;

at least one blade in a blade assembly hydraulically responsive to piston movement resulting from flow in said passage from said upper toward said lower end of said passage for pivoting extension and retraction with respect to the subterranean tubular for respectively cutting through a wall of the tubular and sectioning the tubular in an uphole direction and removal of a severed section of the tubular while supported on said blade assembly for removal of the severed section of the tubular with the apparatus in a continuation of the uphole movement of said blade assembly after said cutting through and sectioning the tubular;

said at least one blade pivoting to full extension before cutting through the wall that has a smaller diameter than an outer dimension of said at least one blade, said blade beginning cutting through the wall in the fully extended position to position said fully extended blade below a smaller dimension of the subterranean tubular for removal thereof.

2. The apparatus of claim 1, wherein:

said piston has a passage therethrough and is driven in a first direction for extension of said blade assembly by flow through said passage.

3. The apparatus of claim 2, wherein:

reduction of said flow allows said piston to move in a second direction opposite said first direction for removal through the tubular being cut.

4. The apparatus of claim 1, wherein:

said piston is moved in a first direction so that said blade assembly is extended by flow through a piston passage that is in flow communication with said mandrel passage, said mandrel further comprising a flow restriction to create back pressure against a lower end of said piston.

5. The apparatus of claim 1, wherein:

said blade assembly pivots about a stationary pivot location on said mandrel.

6. The apparatus of claim 3, wherein:

said piston is biased in said second direction.

7. The apparatus of claim 1, wherein:

said piston is driven in a reverse direction than flow that passes through a piston passage for extension of said blade assembly.

8. The apparatus of claim 1, wherein:

said piston comprises a piston passage that is selectively obstructed so that pressure on said piston with said piston passage obstructed retracts said blade assembly.

9. The apparatus of claim 1, wherein:

said mandrel further comprises a centralizer.

10. The apparatus of claim 6, wherein:

said bias is provided by a mechanical or fluid spring.

11. The apparatus of claim 10, wherein:

said piston is moved in a first direction so that said blade assembly is extended by flow through a piston passage that is in flow communication with said mandrel passage, said mandrel further comprising a flow restriction to create back pressure against a lower end of said piston.

12. The apparatus of claim 11, wherein:

said blade assembly pivots about a stationary pivot location on said mandrel.

13. The apparatus of claim 12, wherein:

said piston is driven in a reverse direction than flow that passes through said piston passage for extension of said blade assembly.

14. The apparatus of claim 13, wherein:

said piston passage is selectively obstructed so that pressure on said piston with said piston passage obstructed retracts said blade assembly.

15. The apparatus of claim 14, wherein:

said mandrel further comprises a centralizer.

16. The apparatus of claim 8, wherein:

said passage is selectively obstructed by a dart that lands on a seat surrounding said piston passage.

17. The apparatus of claim 14, wherein:

said passage is selectively obstructed by a dart that lands on a seat surrounding said piston passage.

18. The apparatus of claim 10, wherein:

said mechanical spring comprises a coiled spring or a stack of Belleville washers.

19. The apparatus of claim 1, wherein:

said blade assembly comprises blades having a top surface cutting structure that when extended facilitate sectioning the tubular in an uphole direction.

* * * * *